United States Patent [19]

Castelli

[11] 4,078,497

[45] Mar. 14, 1978

[54] LIQUID TIMING DEVICE HAVING A FLOATING MASS

[75] Inventor: Vittorio Castelli, Scarsdale, N.Y.

[73] Assignee: Breed Corporation, Fairfield, N.J.

[21] Appl. No.: 386,079

[22] Filed: Aug. 6, 1973

Related U.S. Application Data

[63] Continuation-in-part of Ser. No. 158,364, Jun. 30, 1971, abandoned.

[51] Int. Cl.[2] ..... F42C 15/24

[52] U.S. Cl. ..... 102/78; 102/81

[58] Field of Search ..... 102/76, 78, 79, 80, 102/81; 58/144; 73/490

[56] References Cited

U.S. PATENT DOCUMENTS

| | | | |
|---|---|---|---|
| 2,714,727 | 8/1955 | Stern et al. | 58/144 |
| 3,212,340 | 10/1965 | Benckert | 73/490 |
| 3,397,640 | 8/1968 | Ziemba et al. | 102/81 X |
| 3,425,354 | 2/1969 | Carlson | 102/79 |
| 3,621,782 | 11/1971 | Biggar | 102/79 |
| 3,701,573 | 10/1972 | McQuistion | 102/57 |
| 3,750,589 | 12/1971 | Egli et al. | 102/79 |

*Primary Examiner*—Verlin R. Pendegrass

[57] ABSTRACT

The timing device of this invention includes a housing which contains at least one mechanism whose motion is partially controlled by a liquid which substantially fills the housing and by a mass having a density approximately equal to or less than that of the surrounding liquid.

9 Claims, 4 Drawing Figures

VITTORIO CASTELLI INVENTOR

BY

KANE, DALSIMER, KANE, SULLIVAN AND KURUCZ ATTORNEY

LIQUID TIMING DEVICE HAVING A FLOATING MASS

This application is a continuation-in-part of application Ser. No. 158,364 filed June 30, 1971, and now abandoned.

BACKGROUND OF THE INVENTION

The timing device of the present invention has apllic-tion to solving munition fuzing problems as well as other timing, integrating and revolution counting problems.

In recent years the fuzing for munitions such as projected grenades, 20mm., spinning bomblets and artillery has been increasing in complexity. This has been brought about by the desire for greater safety against possible malfunctions, for greater reliability to prevent dud ammunition and to increase the effectiveness of the munition against special targets. These requirements have tended to be somewhat incompatible and have increased the comlexity and the cost of munition fuzes.

The timing device of the present invention in most applications results in a dramatically simple fuze mechanism while at the same time provides for an increase in fuze safety and accuracy.

For most applications all fuze components are contained in a hermetically sealed housing which is completely filled with a low viscosity liquid. The timing device has applications primarily to spinning projectiles such as artillery, projected grenades, bomblets and gun ammunition. Through a proper choice of materials, one or more of the internal parts of the fuze is made to have approximately the same specific gravity as the fluid which surrounds it. Through this technique, the particular fuze part is relatively unaffected by rapid accelerations of the munition. Thus, in the case of an artillery fuze, for example, the projectile shortly after launch may be spinning at a high angular velocity whereas a particular part within the liquid filled fuze could have a relatively small or negligible angular velocity. This fact coupled with other mechanism permits the counting of revolutions of the projectile and arming of the fuze after a predetermined number of projectile revolutions.

Present 20mm. gun ammunition utilizes the M505 fuze which consists of a ball rotor in a spherical socket. This ball rotor has a polar moment of inertia which exceeds its transverse moments of inertia which in turn are equal. The deonator lies on the polar axis which at the time of projectile launch makes an angle of approximately 80° with the spin axis of the projectile. A mathematical analysis of this fuze will show that in the absence of friction the M505 ball rotor will never align and the time required for alignment when friction is present is a function of the amount of friction and thus of the coefficient of friction, spin eccentricities, and magnitude of the projectile nutation. This has resulted in a wide variation of the arming distances of the standard M505. A typical set of firing test results for example show that some fuzes arm as early as 10 feet whereas a few fuzes require up to 100 feet. Uncontrollable sources of friction have been substantially eliminated from fuzes constructed in accordance with the teachings of this invention resulting in far more consistent arming times. In addition, the M505 does not pass current accepted safety standards for safe separation distance. Fuzes constructed in accordance with the teachings of this invention can be made with considerably longer arming distances and thus are able to satisfy the safety standards.

Other fluid timers using dashpot principles have been applied successfully to solving particular munition fuze timing problems. Most of these dashpots however, have required very tight tolerance control on the moving parts necessitating selective assembly or unusual gaging techniques. For most applications of the timing device of the present invention all of the parts can be produced on standard, high volume production metalworking machines.

In contrast to most fuzes currently produced, the timing device of the present invention is usually hermetically sealed, permitting unprotected storage in such adverse conditions as submerged under 100 feet of water. The hermetically sealed envelope is entirely filled with the damping fluid, and thus all fuze components are unaffected by rough handling or vibrations at any frequency. In addition, for many applications there is no restriction as to the location of the fuze within the munition. This feature, plus the small size, permits the use of multiple timing devices in a single munition even buried within the main explosive charge if extreme reliability is desired.

The total immersion of all fuze components in an inert liquid assures that no degradation of fuze safety of performance over prolonged storage in corrosive environments or extended exposure to severe vibrations or rough handling will take place. Rupture of the seal and loss of the liquid results in a fail safe condition.

The timing device of the present invention can in addition be used with other timing mechanisms such as disclosed in co-pending patent application, Liquid Timing Device, of D. Breed, T. Thuen and A. Breed Ser. No. 158,363, filed 6/30/71, and now abandoned.

Thus, the timing device of the present invention has been eminently successful in eliminating the drawbacks of the prior art in the field of munition fuzing.

SUMMARY OF THE INVENTION

The timing device of the present invention comprises a liquid filled housing containing one or more timers, integrators, or revolution counters wherein the time delays are accomplished through the use of a mass having less or approximately the same density as its surrounding liquid to render the mass relatively insensitive to rapid accelerations of the munition.

One of the primary objects of this invention is to provide for an extremely safe munition fuze.

Aother object of this invention is to provide for an exceptionally reliable munition fuze.

Still another object of this invention is to provide for an exceedingly inexpensive munition fuze.

An additional object of this invention is to provide for a hermetically sealed munition fuze.

Another object of this invention is to provide for a munition fuze which is not degraded by vibration.

A further ofject of this invention is to provide for a munition fuze which can be stored in adverse environments.

Still another object of this invention is to provide for small selfcontained munition fuzing element which permits its redundant use within the munition.

A further object of this invention is to provide a liquid fuze capable of giving constant distance arming for artillery.

Another object of this invention is to provide a munition fuze having a longer arming delay than currently available of gun ammunition.

Still another object of this invention is to provide for a fuze which provides for self-sterilization of a projectile when projectile spin has decayed below a specified value.

Other objects and advantages of this invention will become apparent as the description progresses.

BRIEF DESCRIPTION OF THE DRAWINGS

In the accompanying drawings in which three of various embodiments of the present invention are illustrated.

DESCRIPTION OF THE PREFERRED EMBODIMENTS

Figure 1A:
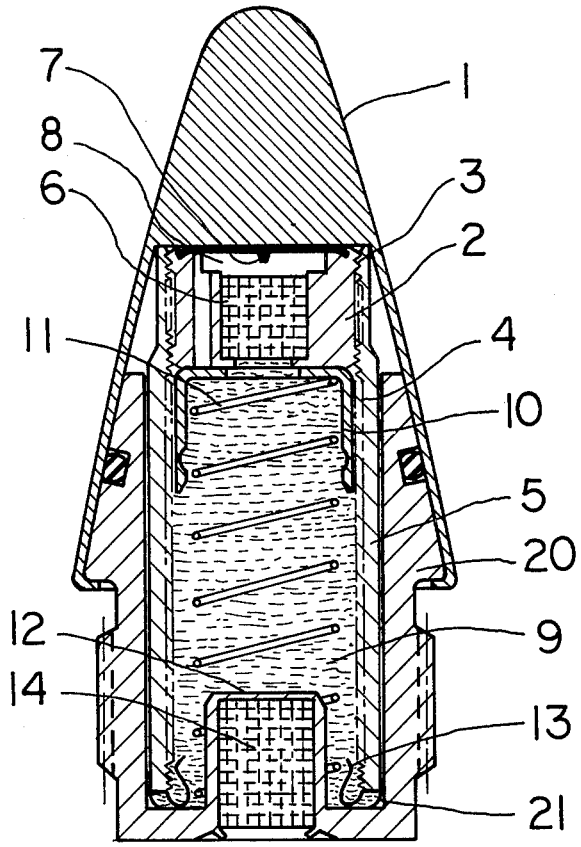
FIG. 1A is a cross-section view of safety and arming delay fuze shown in the unarmed position for 20mm. gun ammunition where arming occurs after a predetermined number of revolutions of the projectile.
Figure 1B:
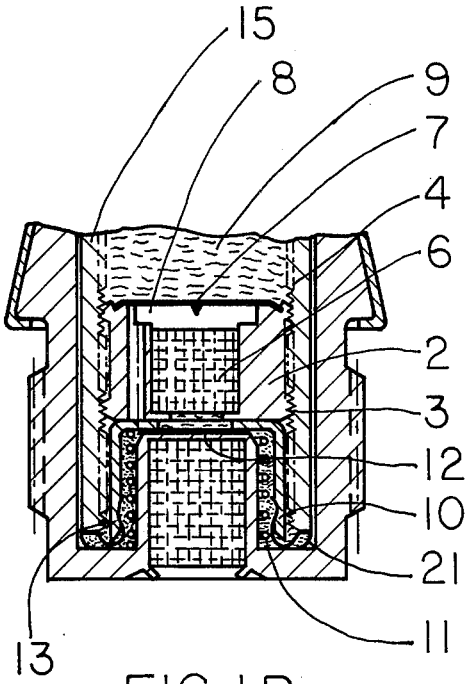
FIG. 1B is a partial cross-section view of the fuze of FIG. 1A showing the armed position.

Referring now to the drawings, apparatus constructed in accordance with the teachings of this invention is shown generally at 1 in FIG. 1A. A rotating member 2 having external threads 3, which mate with internal threads 4 of threaded sleeve 5, contains a detonator 6, a firing pin 7 and a void 8. The remainder of the fuze body cavity 20 is filled with a fluid 9. The density of the rotor assembly 2 is less than or approximately equal to that of fluid 9. Also, in the fuze cavity is a setback mass 10 and bias spring 11. When the projectile is launched, setback mass 10, due to its inertia, begins moving relative to the projectile toward end 12 of the fuze cavity. Its motion is resisted by bias spring 11 and by the flow resistance of fluid 9. Under proper firing conditions, setback weight 10 will reach bottom 12 of the fuze cavity where it is locked down by setback weight lock 13. Lock 13 is formed as part of sleeve 5 bias spring 21. While traveling in the gun barrel, the rifling of the barrel imparts a spin to the projectile. Since the rotor assembly 2 has less or the same density as the fluid 9 the friction forces between the rotor threads 3 and the fuze cavity threads 4 arises only due to relative rotation between the rotor and the fuze. If the clearance between the threads is kept sufficiently large and the fluid viscosity is sufficiently small the angular velocity of the rotor can be kept small in comparison to the angular velocity of the fuze for a sufficient time to permit the rotor to screw downward toward end 12. Thus, the position of the rotor 2 is a convenient measure of the number of revolutions of the projectile. Since the projectile will travel forward a given distance for each revolution, the distance which rotor 2 has moved toward end 12 is also a convenient measure of the distance traveled by the projectile. When rotor 2 reaches end 12 as shown in FIG. 1B, detonator 6 is aligned with lead 14 such that detonator 6 explosion will ignite lead 14 which carries the explosion to ignite the main charge of the munition.

Due to the compressibility of fluid 9, sleeve 5 must be permitted to move slightly in order to minimize the forces between the mating threads during launching of the projectile. For most applications where this is necessary, sleeve 5 will also have a density nearly the same as rotor 2. The clearance between sleeve 5 and fuze housing 20 would be kept small to assure sleeve 5 having an angular velocity nearly the same as the housing 20 dur to viscous shear between the two parts prior to firing, sleeve 5 would be held in its forward most position by sleeve bias spring 21.

The viscous torque exerted on the rotor by the fluid is:

$$T = \sigma AR \quad , (1)$$

The shear stress using the Newtonian definition of viscosity is:

$$\sigma = \dot{\epsilon}\mu \quad (2)$$

Where:
$\sigma$ = shear stress on the rotor
A = the area of the rotor threads
R = radius of the rotor
Where:
$\dot{\epsilon}$ = the shear rate The shear rate can be related to the relative angular velocity.

$$\dot{\epsilon} = \omega R/h \quad (3)$$

Where:
$h$ = the clearance between the threads.
The area of the threads is: ps $$A = 2\pi RL \quad (4)$$

Where:
$L$ = the axial length of the threaded surface

These equations can be combined to give:

$$T = (R^3\, \omega 2\pi L\mu)/h \quad (5)$$

The angular acceleration of the rotor is:

$$\dot{\omega}' = (T/I) \quad (6)$$

And the angular velocity of the rotor can be obtained $$\omega' = (T/I)dt \quad (7)$$

Where:
$I$ = the polar moment of inertial of the rotor.

For most applications it would be desirable for $\omega'$ to not exceed 10% of the angular velocity of the projectile until the detonator aligns with the lead. This can be accomplished by using large clearance between the threaded surfaces and by using and by using a low viscosity fluid 9. For some applications even this will be insufficient, however, and an alternative design which uses a threaded hole in the rotor mating with a threaded rod permanently attached to the ends of the fuze cavity would be utilized. Since the torque is proportional to the cube of the thread radius, placing the thread inside of the rotor would significantly reduce the viscous torque. This of course does result in some added complexity. Another alternative would be to move most of the threads 2 retaining in the extreme case only a small portion of a single thread. Calculations would be of course required for each specific design and could easily be accomplished by those skilled in the art.

The firing pin 7, void 8 amd detonator 6 are shown in an arrangement which greatly enhances the probability of round functioning. When the detonator is aligned, practically any crushing or deformation of the projectile nose will significantly increase the ambient pressure within the fluid 9. This increase is pressure acting on the firing pin plate 15 drives the firing pin 7 into detonator 6.

Figure 1C:
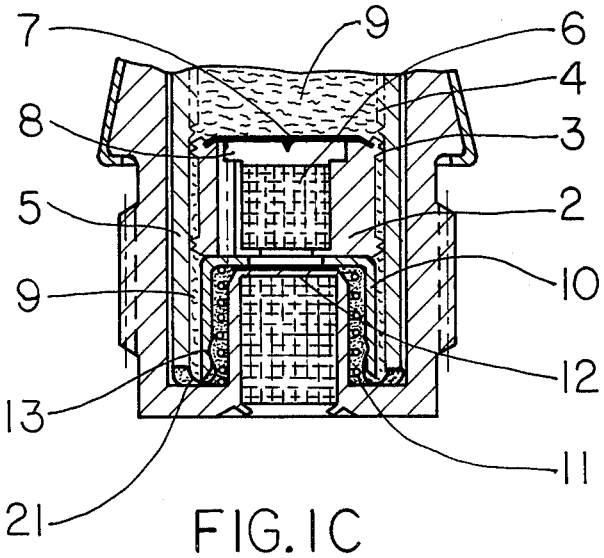
FIG. 1C is a partial cross-section view of the fuze of FIG. 1A showing a portion of the threads removed to permit return of the fuze to the unarmed position of spin decay.
Figure 1D:
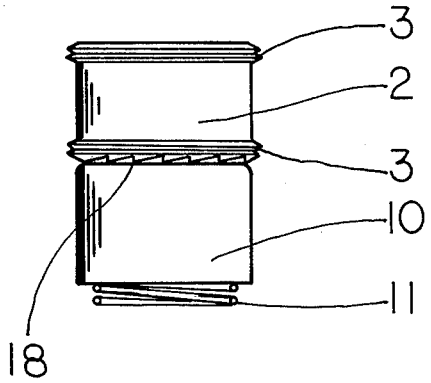
FIG. 1D is a view of the rotor of FIG. 1C showing the thrust bearing.

In an alternate arrangement the last several of threads 4 can be removed as shown in FIG. 1C. Rotor 2 will leave the threaded portion of the fuze cavity just prior to reaching the end of its travel. Placing the detonator close enough to the lead for propagation of the explosive without the rotor physically contacting the safety weight 10 which is locked down by lock 13. Fluid forces acting on the rotor 2 will gradually bring the angular velocity of the rotor to where it is equal to the angular velocity of the projectile. Aerodynamic drag, however, gradually reduces the projectile angular velocity such that at some point the rotor angular velocity exceeds the angular velocity of the projectile. If, in addition, surface 18 of rotor 2 is constructed with steps as shown in FIG. 1D, in such a manner as to create a slight lift to rotor 2 as, for example, in the case of a hydrodynamic thrust bearing, the threads 3 of rotor 2 will re-engage the threads 4 of the fuze cavity and the rotor will slowly return to its starting position sterilizing the projectile. Such a system could be utilized for example in 20mm. gun ammunition when used in ground-to-air or air-to-air engagements over friendly territory to prevent the return to earth of live ammunition.

A computer solution of the above equations for a particular case results in a time delay which is approximately inversely proportional to the viscosity for low viscosity fluids and directly proportional to the viscosity for high viscosity fluids. Over a narrow range of intermediate viscosities, the time delay is nearly independent of the viscosity. Operation in this range would of course be desirable for cases where the fuze must function with a reasonably constant time delay over varying temperatures. The particular viscosities at which temperature affects are minimized must be determined for each fuze configuration and can be accomplished by those skilled in the art of computer programming and numerical analysis using the above equations.

In each case above, the liquid serves to float the fuze parts having less or approximately the same density as the fluid, thus greatly reducing the forces between the floating parts and the housing or other parts of the fuze. Here floating is used to represent the situation where the buoyant forces on a part are greater of approximately equal to the weight of the part. In this situation the floating parts will not be strongly influenced by setback accelerations during projectile launch, angular accelerations of the munition eccentric spinning of the munition or other uncontrollable motions such as nutation and precession of the munition. Thus, for a period of time the floating parts can perform functions relatively unhampered by controllable friction forces.

The fluids used in this invention generally have a specific gravity of between 1.7 and 2.8 and are chosen from the class of fluids known as halocarbon fluids. Dibromomethane having a specific gravity of about 2.5 has been particularly successful.

Thus the numerous aformentioned objects and advantages among others are most effectively obtained. Although three preferred embodiments and applications have been described, disclosed and illustrated above, it should be understood that this invention is in no sense limited thereby but its scope is to be determined by that of the appended claims. In particular, numerous other geometries and applications should now be evident to those skilled in the art.

I claim:

1. A projectile timing device combination comprising a rotatable projectile and means for incorporating the timing device in the projectile; a liquid tight sealed housing; a mass in said housing; liquid in said housing surrounding the mass permitting the mass to move therein relative to said housing; the density of the mass being generally close to or less than that of the liquid; means including the liquid for isolating the mass from the housing to permit relative rotation of the mass and housing; the respective densities of the mass and the liquid being such that the liquid applies buoyant forces on the mass and upon movement of the mass within the liquid relative to the housing, movement is substantially effected by the inertial forces and the buoyant forces acting on the mass and projectile and the means being used to materially reduce friction forces arising from contact between the mass and the housing, the movement of the mass relative to the housing providing a predetermined time delay, the mass being adapted to rotate at a smaller angular velocity than that of the projectile.

2. The invention in accordance with claim 1, wherein the projectile is a rotating munition, said time delay includes means for approximately counting the number of turns of the rotating munition.

3. The invention in accordance with claim 1, wherein the projectile includes a munition fuze and means are provided to adapt the timing device to a munition fuze.

4. The invention in according with claim 3, wherein the projectile includes artillery fuzing and means are provided to adapt the timing device mechanism to artillery fuzing.

5. The invention in accordance with claim 3, wherein the projectile includes gun ammunition fuzing and means are provided to adapt the timing device to gun ammunition fuzing.

6. The invention in accordance with claim 5 wherein said gun ammunition is selected from the group comprising 20mm to 40mm.

7. The invention in accordance with claim 1 wherein means are provided to achieve arming followed by self-sterilization of a munition fuze wherein self-sterilization of a munition fuze wherein self-sterilization is accomplished by spin decay of the munition.

8. The invention in accordance with claim 1 wherein the fluid is one of the halocarbon fluids.

9. The invention in accordance with claim 1 wherein the fluid has a specific gravity between 1.7 and 2.8.

* * * * *